US006253747B1

(12) United States Patent
Sell et al.

(10) Patent No.: US 6,253,747 B1
(45) Date of Patent: Jul. 3, 2001

(54) TORSIONAL COUPLING FOR SUPERCHARGER

(75) Inventors: Craig E. Sell, Marshall; Matthew G. Swartzlander, Battle Creek, both of MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/512,906

(22) Filed: Feb. 25, 2000

(51) Int. Cl.[7] ..... F02B 33/00

(52) U.S. Cl. ..... 123/559.1; 418/206; 464/66; 464/67

(58) Field of Search ..... 123/559.1; 418/69, 418/182, 201, 206; 464/57, 66, 67, 160

(56) References Cited

U.S. PATENT DOCUMENTS 3,195,324 * 7/1965 Sellwood et al. .
4,564,345 * 1/1986 Mueller ..... 418/206
4,844,044 7/1989 McGovern ..... 123/559.1
4,944,279 * 7/1990 Woodard ..... 123/559.1
4,953,517 * 9/1990 McGovern et al. ..... 123/559.1

* cited by examiner

*Primary Examiner*—Hoang Nguyen
(74) *Attorney, Agent, or Firm*—L. J. Kasper

(57) ABSTRACT

A supercharger (26) has first (28) and second (29) meshed lobed rotors, each having associated therewith a timing gear (62), the timing gears being meshed to prevent contact of the meshed lobes of the rotors (28,29). Input torque to the supercharger (blower) is by an input shaft (54), with torque being transmitted to the timing gear through a torsion damping mechanism. In accordance with the invention, the damping mechanism comprises the timing gear and an input hub (70) defining cylindrical outer (86) and inner (88) surfaces, with a torsion spring (76) disposed radially therebetween. The spring defines a normal inside diameter (90) which is spaced apart from the outer surface (86) by an amount corresponding to a predetermined positive travel limit. For a different engine application, the mechanism may be adapted by merely providing a different diameter for the outer surface (86), thus changing the travel limit.

7 Claims, 5 Drawing Sheets

TORSIONAL COUPLING FOR SUPERCHARGER

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to a rotary blower and more particularly, to a torsion damping mechanism for reducing audible noise from the timing gears in a rotary blower driven by an internal combustion engine.

It should be understood by those skilled in the art that the present invention is not limited to a Roots-type blower, but could be used just as advantageously in a screw compressor type of blower. A Roots-type blower transfers volumes of air from the inlet port to the outlet port, whereas a screw compressor actually achieves internal compression of the air before delivering it to the outlet port. However, for purposes of the present invention, what is most important is that the blower include a pair of rotors which must be timed in relationship to each other, and therefore, are driven by meshed timing gears which are potentially subject to conditions such as gear rattle and bounce as described above.

Rotary blowers of the type to which the present invention relates are also referred to as "supercharges" because they effectively super charge the intake of the engine. Typically, the pulley and belt drive arrangement for a Roots blower supercharger is sized such that, at any given engine speed, the amount of air being transferred into the intake manifold is greater than the instantaneous displacement of the engine, thus increasing the air pressure within the intake manifold, and increasing the power density of the engine.

Rotary blowers of either the Roots type or the screw compressor type, are characterized by the potential to generate noise. For example, Roots-type blower noise may be classified as either of two types. The first is solid borne noise caused by rotation of timing gears and rotor shaft bearings subjected to fluctuating loads (the firing pulses of the engine), and the second is fluid borne noise caused by fluid flow characteristics, such as rapid changes in fluid (air) velocity. The present invention is concerned primarily with the solid borne noise caused by the meshing of the timing gears. More particularly, the present invention is concerned with minimizing the "bounce" of the timing gears during times of relatively low speed operation, when the blower rotors are not "under load". Thus, it is important to be able to isolate the fluctuating input to the supercharger from the timing gears. The noise which may be produced by the meshed teeth of the timing gears during unloaded (non-supercharging) low speed operation is also referred to as "gear rattle".

An example of a prior art torsion damping mechanism for a supercharger is illustrated and described in U.S. Pat. No. 4,844,044, assigned to the assignee of the present invention, and incorporated herein by reference. Although the device of the incorporated patent has been generally satisfactory in terms of operational performance, the number of parts required, and the nature of those parts, and the requirement for two different spring members, has in some cases made the total manufacturing and assembly cost of the torsion damping mechanism exceed what is commercially feasible for the particular vehicle application.

Inherent in the design of the torsion damping mechanism of the above-incorporated patent is a very limited amount of travel in the positive torque direction. For example, in a damping mechanism sold commercially by the assignee of the present invention, the maximum travel was in the range of about 10 to about 15 degrees. The only way to adapt ("tune") a particular damping mechanism to a different engine application (i.e., a different input impulse loading) is to replace the spring with one having a different spring rate. However, in many cases the result would be a spring which would be too stiff for the particular engine application.

Typically, the known prior art torsion damping mechanisms utilized between the input shaft and the timing gears of vehicle engine superchargers have operated in either an isolation (damping) mode, such as when torque is being transmitted through a spring, or in a direct drive mode, when the damping mechanism effectively performs like a solid mechanical member. Unfortunately, in most of the conventional torsion damping mechanisms, the transition between the isolation mode and the direct drive mode has been sudden, rather than gradual. An abrupt transition between operating modes can generate noise, such as from the impact of engagement of various elements of the torsion damping mechanism.

BRIEF SUMMARY OF THE INVENTION

Accordingly, it is an object of the present invention to provide a rotary blower including an improved torsion damping mechanism which overcomes the above-described disadvantages of the prior art.

It is a more specific object of the present invention to provide such a rotary blower and improved torsion damping mechanism which is extremely simple, inexpensive, and compact.

It is a related object of the present invention to provide such a rotary blower and improved torsion damping mechanism which can readily be adapted to different engine applications with only minimal change in the design of the mechanism.

It is another object of the present invention to provide such an improved torsion damping mechanism which has the capability of a gradual transition, rather than a sudden and harsh transition, between the isolation mode and the direct drive mode.

The above and other objects of the invention are accomplished by the provision of a rotary blower comprising a housing, first and second meshed lobed rotors rotatably disposed in the housing for transferring relatively low pressure inlet port air to relatively high pressure outlet port air. First and second meshed timing gears are fixed to the first and second rotors, respectively, for preventing contact of the meshed lobes. An input drive is adapted to be rotatably driven by a positive torque, about an axis of rotation in one drive direction at speeds proportional to speeds of a periodic combustion torque transmitting engine selectively controllable between idle and relatively higher speeds. The rotary blower includes a torsion damping mechanism for transmitting engine torque from the input drive to the first timing gear.

The rotary blower is characterized by the torsion damping mechanism comprising one of the input drive and the first timing gear defining an inner cylindrical surface, and one of the input drive and the first timing gear defining an outer cylindrical surface, both the inner and outer cylindrical surfaces being concentric about the axis of rotation. A helical torsion spring has an input end fixed to rotate with the input drive and an output end fixed to rotate with the first timing gear. The torsion spring defines a normal inside diameter surrounding the outer cylindrical surface, and spaced apart therefrom by an amount corresponding to a predetermined positive travel limit. The torsion spring defines a normal outside diameter, being surrounded by the inner cylindrical surface, which is spaced apart therefrom by an amount corresponding to a predetermined negative travel limit.

DETAILED DESCRIPTION OF THE PREFERRED EMBODIMENT

Figure 1:
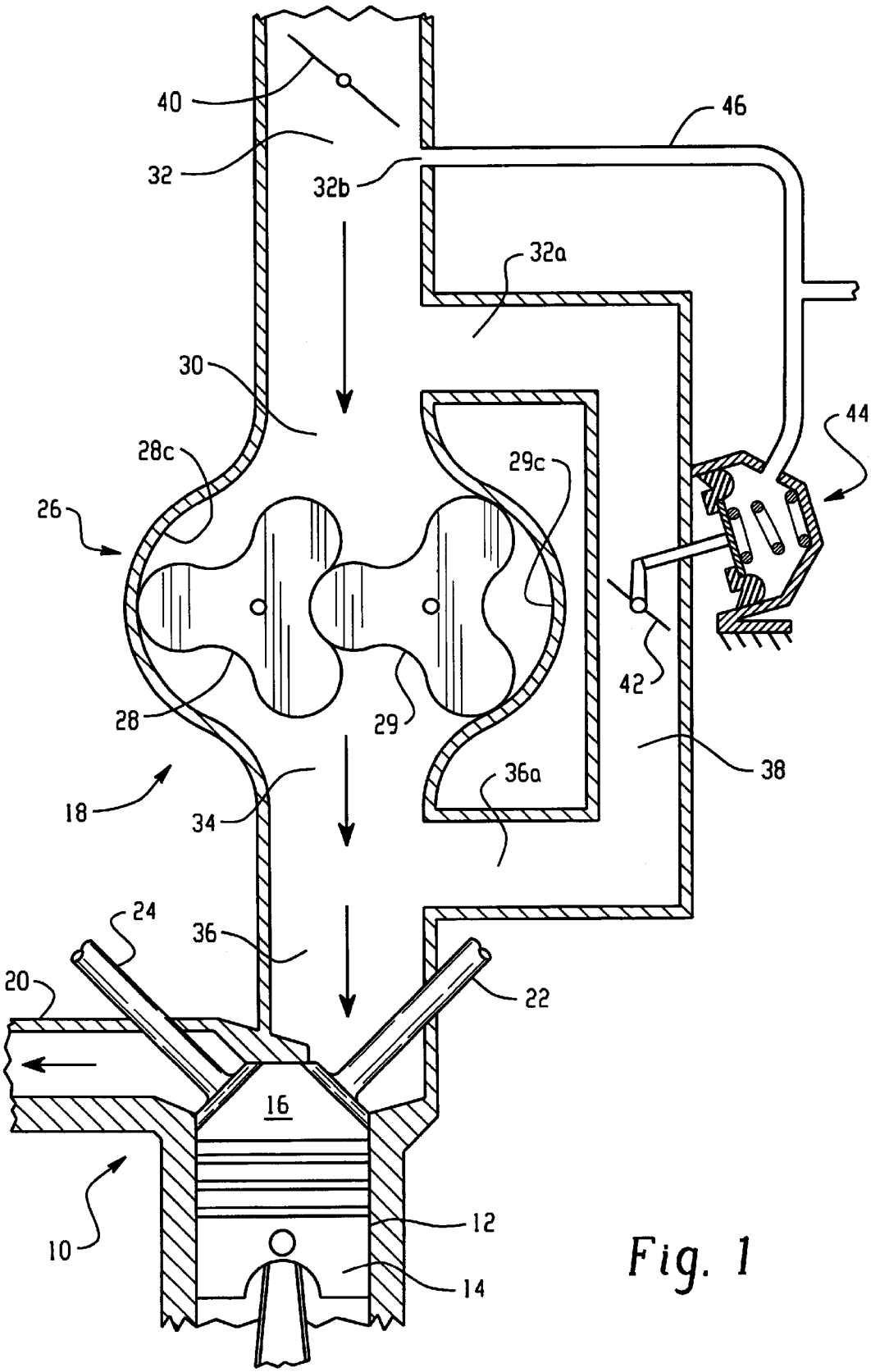
FIG. 1 is a schematic illustration of an intake manifold assembly having a positive displacement blower or supercharger therein for boosting intake pressure to an internal combustion engine.

Referring now to the drawings, which are not intended to limit the invention, FIG. 1 is a schematic illustration of an intake manifold assembly, including a Roots blower supercharger and bypass valve arrangement of the type which is now well known to those skilled in the art. An engine, generally designated 10, includes a plurality of cylinders 12, and a reciprocating piston 14 disposed within each cylinder, thereby defining an expandable combustion chamber 16. The engine includes intake and exhaust manifold assemblies 18 and 20, respectively, for directing combustion air to and from the combustion chamber 16, by way of intake and exhaust valves 22 and 24, respectively.

The intake manifold assembly 18 includes a positive displacement rotary blower 26 of the backflow or Roots type, as is illustrated and described in U.S. Pat. Nos. 5,078,583 and 5,893,355, assigned to the assignee of the present invention and incorporated herein by reference. The blower 26 includes a pair of rotors 28 and 29, each of which includes a plurality of meshed lobes. The rotors 28 and 29 are disposed in a pair of parallel, transversely overlapping cylindrical chambers 28*c* and 29*c*, respectively. The rotors may be driven mechanically by engine crankshaft torque transmitted thereto in a known manner, such as by means of a drive belt (not illustrated herein). The mechanical drive rotates the blower rotors at a fixed ratio, relative to crankshaft speed, such that the blower displacement is greater than the engine displacement, thereby boosting or supercharging the air flowing to the combustion chambers 16.

The supercharger or blower 26 includes an inlet port 30 which receives air or air-fuel mixture from an inlet duct or passage 32, and further includes a discharge or outlet port 34, directing the charged air to the intake valves 22 by means of a duct 36. The inlet duct 32 and the discharge duct 36 are interconnected by means of a bypass passage, shown schematically at 38. If the engine 10 is of the Otto cycle type, a throttle valve 40 preferably controls air or air-fuel mixture flowing into the intake duct 32 from a source, such as ambient or atmospheric air, in a well known manner. Alternatively, the throttle valve 40 may be disposed downstream of the supercharger 26.

Disposed within the bypass passage 38 is a bypass valve 42 which is moved between an open position and a closed position by means of an actuator assembly, generally designated 44. The actuator assembly 44 is responsive to fluid pressure in the inlet duct 32 by means of a vacuum line 46. Therefore, the actuator assembly 44 is operative to control the supercharging pressure in the discharge duct 36 as a function of engine power demand. When the bypass valve 42 is in the fully open position, air pressure in the duct 36 is relatively low, but when the bypass valve 42 is fully closed, the air pressure in the duct 36 is relatively high. Typically, the actuator assembly 44 controls the position of the bypass valve 42 by means of suitable linkage. Those skilled in the art will understand that the illustration herein of the bypass valve 42 is by way of generic explanation and example only, and that, within the scope of the invention, various other bypass configurations and arrangements could be used, such as a modular (integral) bypass or an electronically operated bypass, or in some cases, no bypass at all.

Figure 2:
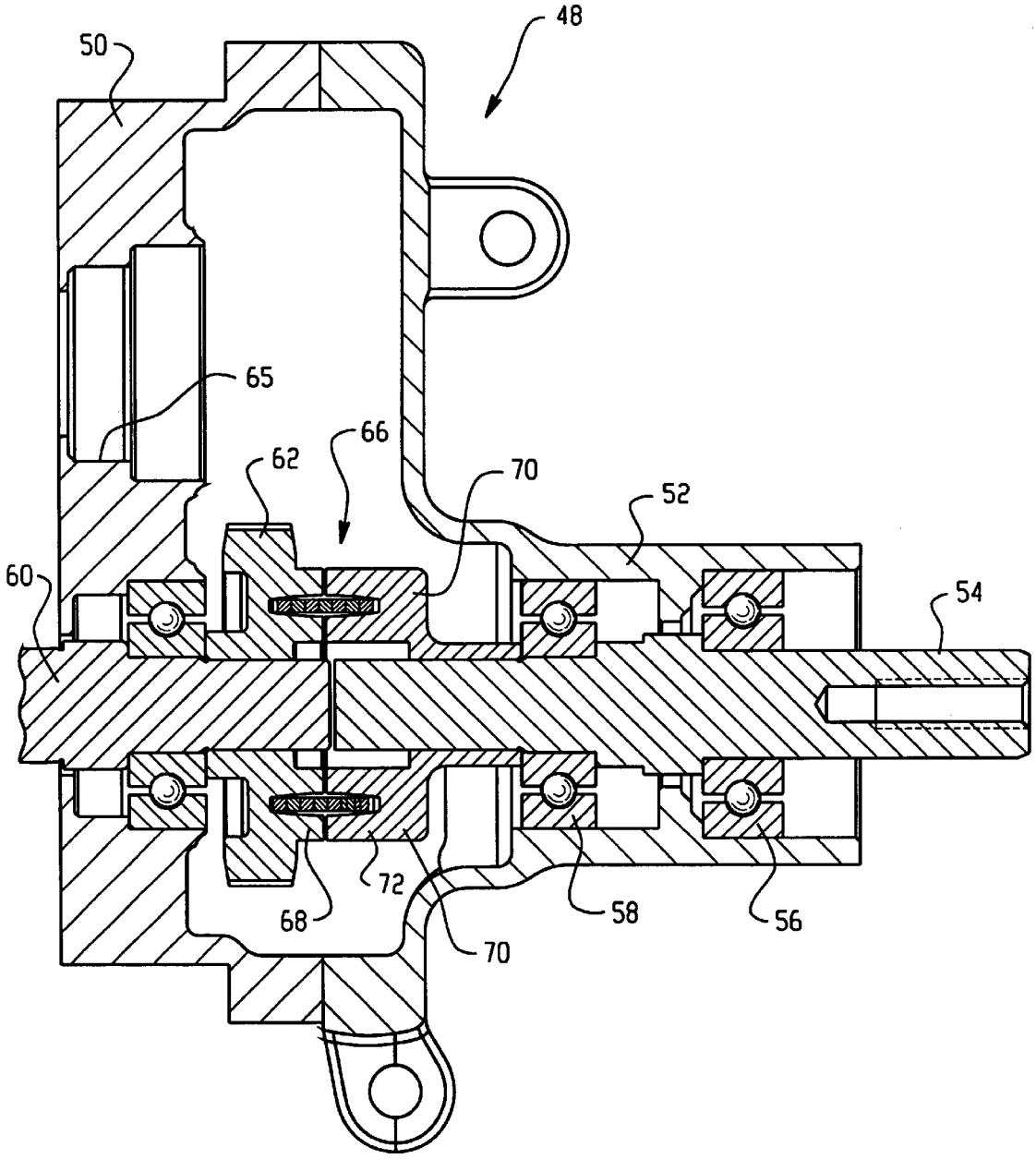
FIG. 2 is an enlarged, fragmentary, axial cross-section of the input section of the supercharger.

Referring now primarily to FIG. 2, there is illustrated an input section, generally designated 48, of the blower 26. The input section 48 includes a housing member 50, which forms a forward end of the chambers 28*c* and 29*c*. Attached to the housing member 50 is a forward housing 52 within which is disposed an input shaft 54, supported within the forward housing 52 by means of a pair of bearing sets 56 and 58. Rotatably supported by the housing member 50 is a rotor shaft 60, upon which is mounted the blower rotor 28 (see FIG. 1). Mounted on the forward end of the rotor shaft 60 is a timing gear 62, defining a set of straight spur gear teeth 64. Those skilled in the art will understand that the gear teeth 64 of the timing gear 62 would be in meshed engagement with the gear teeth of another timing gear (not shown herein), the second timing gear being mounted on a second rotor shaft. The second rotor shaft would be supported within a counterbore 65, and would be in driving engagement with the blower rotor 29.

Typically, positive torque is transmitted from an internal combustion engine (of the periodic combustion type) to the input shaft 54 by any suitable drive means, such as a belt and pulley drive system (not shown herein). Torque is transmitted from the input shaft 54 to the rotor shaft 60 by means of a torsion damping mechanism, generally designated 66. Whenever the engine is driving the timing gears and the blower rotors 28 and 29, such is considered to be the transmission of positive torque. On the other hand, whenever the momentum of the rotors 28 and 28 overruns the input from input shaft 54, such is considered to be the transmission of negative torque.

Figure 3:
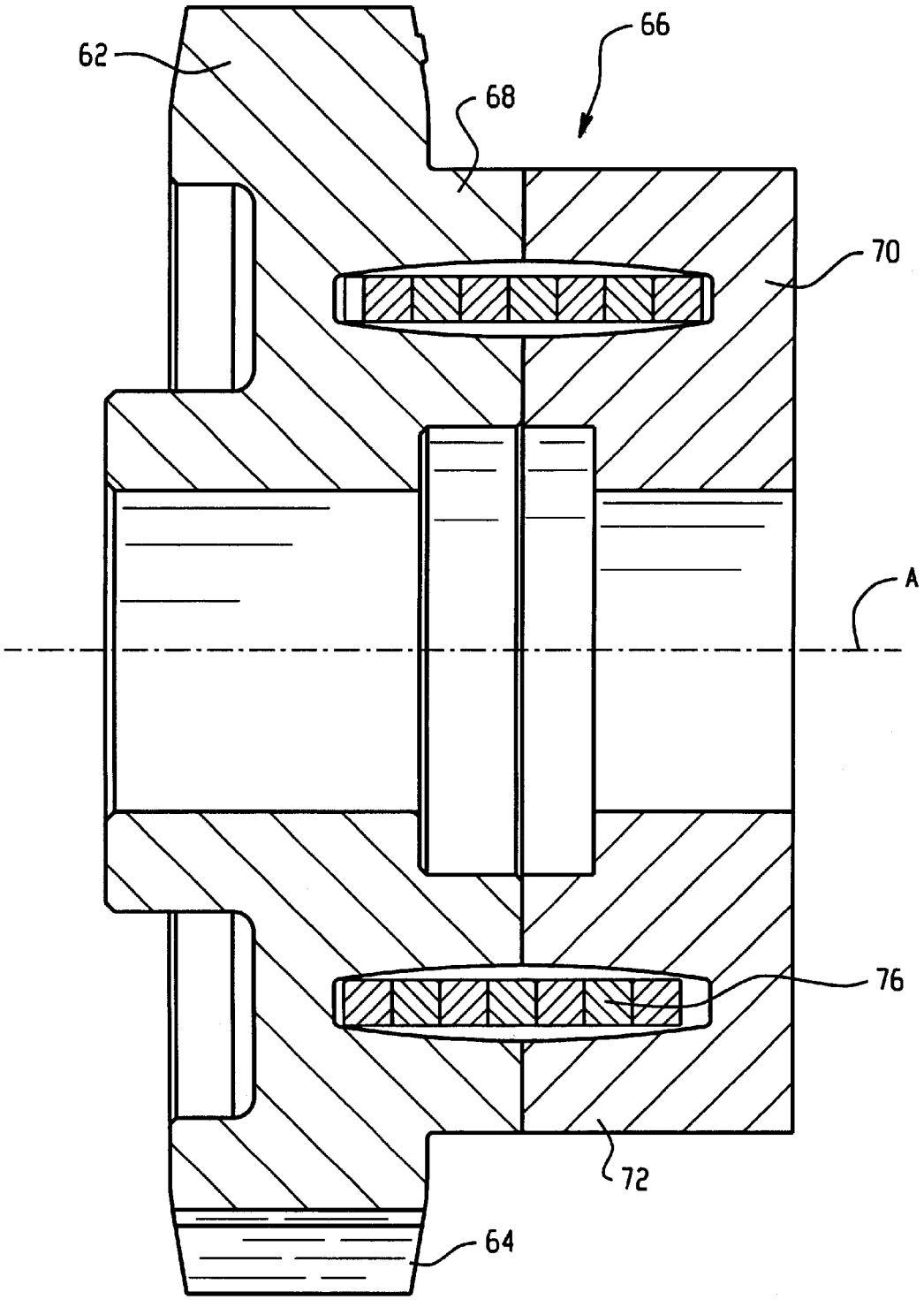
FIG. 3 is a further enlarged axial cross-section of the torsion damping mechanism of the present invention.
Figure 4:
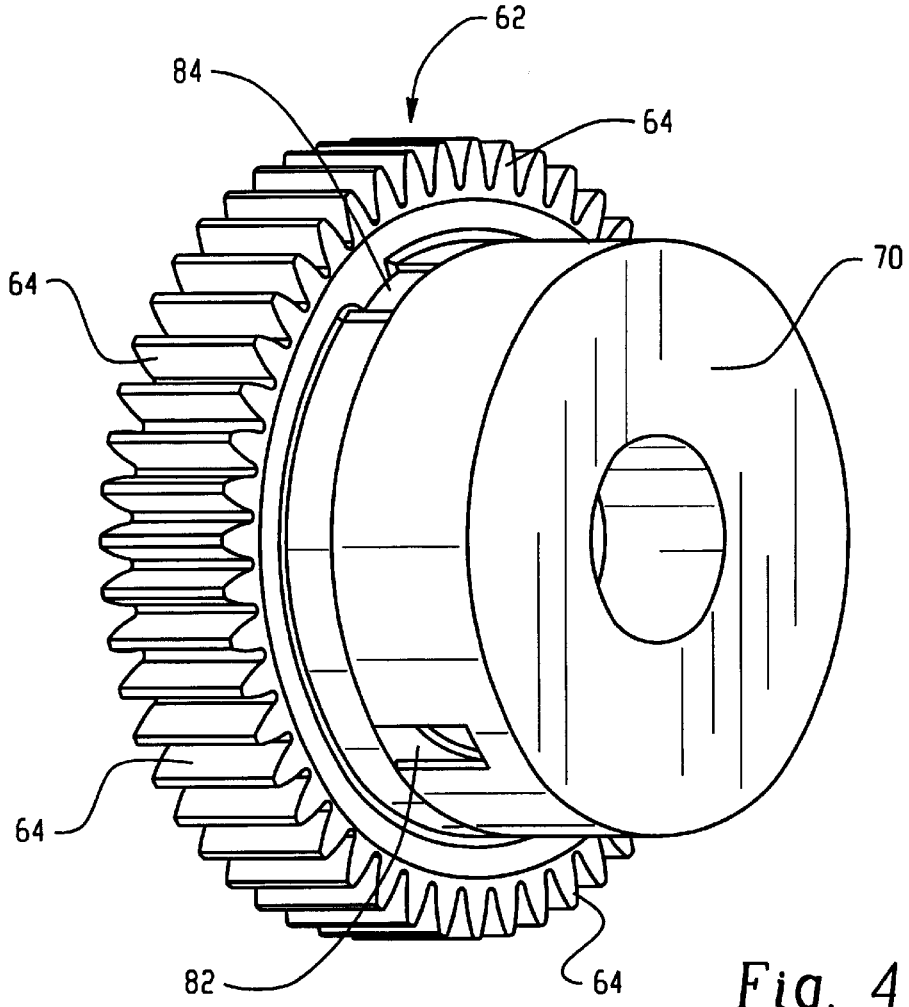
FIGS. 4 and 5 are perspective views of the primary elements of the torsion damping mechanism of the present invention, on a scale reduced from that of FIG. 3.
Figure 5:
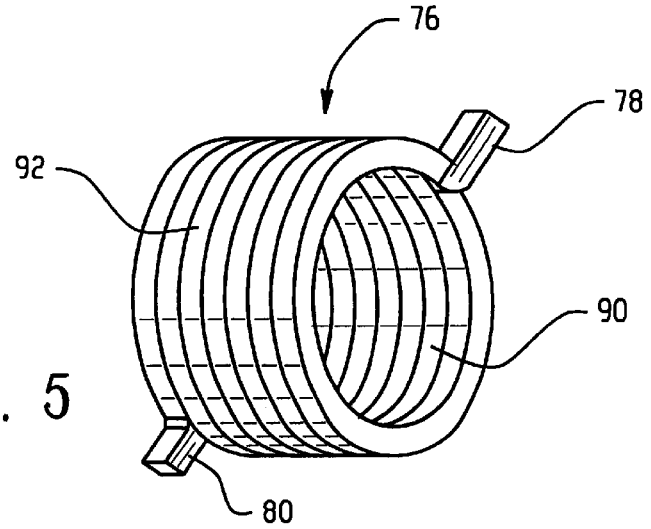

Referring now primarily to FIGS. 3 through 5, the torsion damping mechanism 66 will be described in greater detail. In accordance with one important packaging aspect of the invention, the torsion damping mechanism 66 preferably includes the timing gear 62, which is fixed to rotate with a forward end of the rotor shaft 60, but with the timing gear 62 including a forward, driven portion 68, preferably formed integrally therewith, although such is not an essential feature of the invention. Disposed in face-to-face relationship with the driven portion 68 is an input hub, generally designated 70, including a rearward drive portion 72, which likewise is preferably formed integrally therewith, although such is also not an essential feature of the invention. The input hub 70 if fixed to rotate with a rearward portion of the input shaft 54. By way of example only, the timing gear 62 and the input hub 70 could be press-fit on the shafts 60 and 54, respectively.

Figure 6:
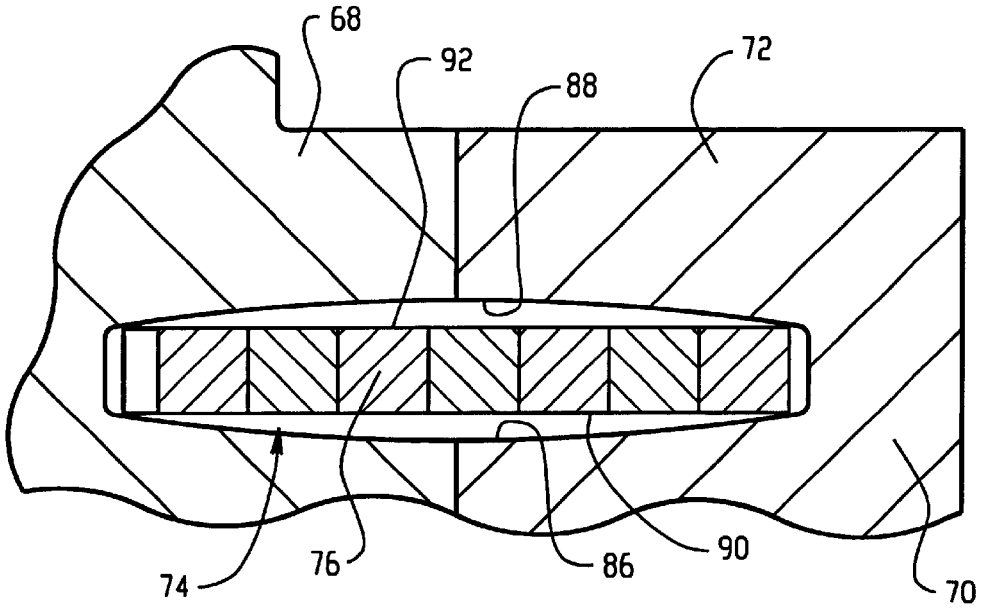
FIG. 6 is an enlarged, fragmentary, axial cross-section, similar to FIG. 3, illustrating one important aspect of the present invention.

It should be noted that FIG. 2 shows one embodiment of the input hub 70, having a forwardly-extending, reduced diameter portion, whereas FIGS. 3 and 4 illustrate a somewhat modified, simpler version of the input hub 70, the differences therebetween being insignificant for purposes of the present invention. It should also be noted that whereas FIG. 2 illustrates the forward driven portion 68 being slightly spaced apart from the drive portion 72, FIGS. 3 and 6 illustrate the portions 68 and 72 being in, or nearly in engagement. Again, such differences are not significant to the present invention.

Referring now primarily to FIG. 6, the driven portion 68 and the drive portion 72 cooperate to define a generally annular spring chamber 74, within which is disposed a torsion spring 76 (see also FIG. 5). The spring 76 includes a forward tang 78 and a rearward tang 80, each of which extends radially in the subject embodiment, but could within the scope of the invention also extend tangentially or axially. The forward tang 78 may be received in a radial notch 82 defined by the drive portion 72 of the input hub 70 (see FIG. 4), while the rearward tang 80 may be received in a radial notch 84 defined by the driven portion 68 of the timing gear 62.

Referring again to FIG. 6, the driven portion 68 and the drive portion 72 cooperate to define an outer cylindrical surface 86, and also cooperate to define an inner cylindrical surface 88. It should be understood by those skilled in the art that, within the scope of the invention, either the driven portion 68 of the timing gear 62 or the drive portion 72 of the input hub 70 could define all of the outer surface 86, and similarly, either the timing gear 62 or the input hub 70 could define all of the inner surface 88. However, what is illustrated herein is a presently preferred embodiment in which a portion of each of the outer and inner surfaces 86 and 88, respectively, is defined by both the driven portion 68 and the drive portion 72. References hereinafter, and in the appended claims, to the timing gear and the input hub defining the outer and inner surfaces 86 and 88 will be understood to mean and include structure defining those surfaces which is separate from, but fixed to rotate with, the timing gear 62 and the input hub 70.

As may best be seen in FIG. 6, the torsion spring 76 preferably has a cross-section which is generally rectangular or square, such that the torsion spring 76 defines a normal inside diameter 90 and a normal outside diameter 92. As used herein, the term "normal" refers to the diameter of the spring 76 at rest, with no torque being transmitted by the spring. Thus, when the spring 76 is at rest, it defines a generally cylindrical inner surface, and a generally cylindrical outer surface, the surfaces also bearing the reference numerals 90 and 92, respectively.

In regard to the operation of the damping mechanism, when the vehicle engine is not operating, the spring 76 is at rest. When the engine begins to operate, torque is transmitted from the engine to the input shaft 54, and then to the input hub 70. The drive torque (positive torque) is then transmitted to the spring 76, which, as the toque increases, begins to wind about the outer cylindrical surface 86. The space between the outer surface 86 and the inside diameter 90 of the spring 76, when it is at rest, determines the positive travel limit, i.e., the amount of travel (rotation of hub 70 relative to timing gear 62) in the positive torque direction, before there is a "stop". The referenced stop occurs when the spring 76 is tightly wrapped about the outer cylindrical surface 86, over substantially the entire axial length of the spring 76.

As the spring 76 is winding about the surface 86, the torsion damping mechanism is said to be operating in the isolation mode. After the spring 76 is tightly wrapped about the surface 86 (engages the stop), and as long as a positive torque condition continues, the mechanism is said to be operating in the direct drive mode, in the manner of a solid mechanical element. In other words, the effective torsion damping is occurring during the isolation mode, typically corresponding to relatively low speeds, which is when the blower is subject to gear rattle, as was described in the

BACKGROUND OF THE DISCLOSURE.

If the driver later decelerates, thus reducing the input torque to the input shaft 54, a condition of negative torque may occur in which the momentum of the rotors 28 and 29 causes the rotors to overrun the input. In this condition, the timing gear will rotate somewhat faster than the input hub 70 (negative torque) until the spring 76 changes from its wrapped condition just described, to a condition in which the spring 76 unwinds to the extent that the outside diameter 92 engages the inner cylindrical surface 88, over the entire axial extent of the spring 76. In a manner similar to positive travel, the space between the inner surface 88 and the outside diameter 92 of the spring 76, when it is at rest, determines the negative travel limit, i.e., the amount of travel (overrunning rotation of timing gear 62 relative to the input hub 70) in the negative torque direction, before there is a "stop". The referenced stop occurs when the spring 76 is tightly unwound within the inner cylindrical surface 88, over substantially the entire axial length of the spring 76.

It is believed to be within the ability of those skilled in the art, based upon a reading and understanding of this specification, to select the spring 76, and its various dimensions, as well as the dimensions of the surfaces 86 and 88, to achieve the desired positive and negative travel limits. By way of example only, it has been determined in connection with the development of the present invention that the travel limit, in either the positive or negative direction could be well in excess of sixty degrees, with the travel of the mechanism being limited by only the fatigue life and the stress capability of the spring.

Although not an essential feature of the present invention, it is preferred that positive torque (which occurs during a much greater portion of the total duty cycle than does negative torque) cause the spring 76 to wrap, rather than unwrap. With the spring 76 wrapping about the surface 86, the centrifugal forces acting on the spring 76 have no substantial effect on the spring rate of the spring 76, whereas, as is well known to those skilled in the art, such forces would have more of an effect with the spring unwrapping.

Figure 7:
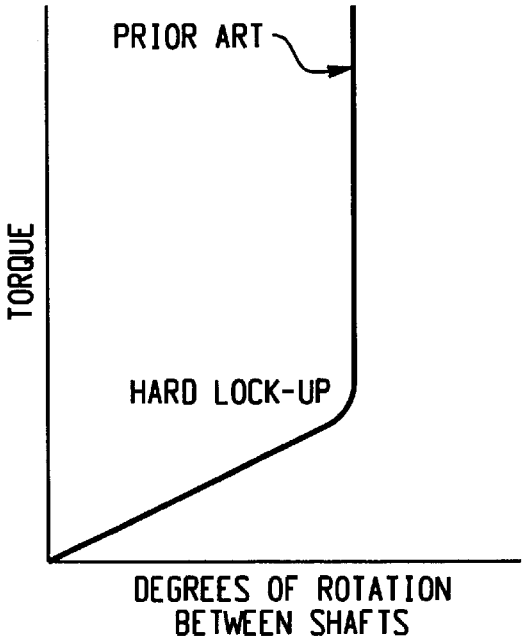
FIGS. 7 and 8 are graphs of torque versus degrees of rotation, comparing the conventional prior art and the present invention, respectively.

Within the scope of the invention, the outer cylindrical surface 86 could be truly cylindrical, i.e., parallel to an axis of rotation A (see FIG. 3) over the entire axial length of the surface 86. Similarly, within the scope of the invention, the inner cylindrical surface 88 could be truly cylindrical, i.e., parallel to the axis of rotation A over the entire axial length of the surface 88. In that case, the outer cylindrical surface 86 would be parallel to the inner surface 90 of the spring 76, and the inner cylindrical surface 88 would be parallel to the outer surface 92 of the spring 76, over substantially the entire axial length of the spring. If all of the surfaces were parallel, wrapping or unwrapping of the spring 76 would result in a uniform decrease in the clearance between, e.g., the inner surface 90 of the spring and the outer cylindrical surface 86. The resulting torque curve would look like that shown in FIG. 7, which also represents the known prior art, in which the torque increases gradually (isolation mode) as a function of degrees of rotation, until the spring has wound up to the point that the radial clearance decreases to zero. When that would occur, the inside diameter 90 would engage the outer surface 86 all at once, over the entire length of the spring 76, resulting in a "hard lock-up". Thereafter, the torque would increase further (direct drive mode) without any further relative rotation between the input hub 70 and the timing gear 62.

However, in accordance with a preferred embodiment of the invention, and as shown in FIGS. 3 and 6, each of the surfaces 86 and 88 is tapered, with the surface 86 having its minimum diameter at the junction of the drive portion 72 and driven portion 68, and the surface 88 having its maximum diameter at that same junction. If, for example, there is a positive torque, and the spring 76 begins to wind about the surface 86, the first contact will occur between the two end coils of the spring and the surface 86. With the two end coils engaging the surface 86, there are now fewer "free" or available coils (turns), and therefore, the spring rate increases (i.e., it takes more torque to continue to wind the coil). Then the next two end coils engage the surface 86, and the spring rate increases further, etc., until all of the turns of the spring 76 are wrapped about the surface 86.

Figure 8:
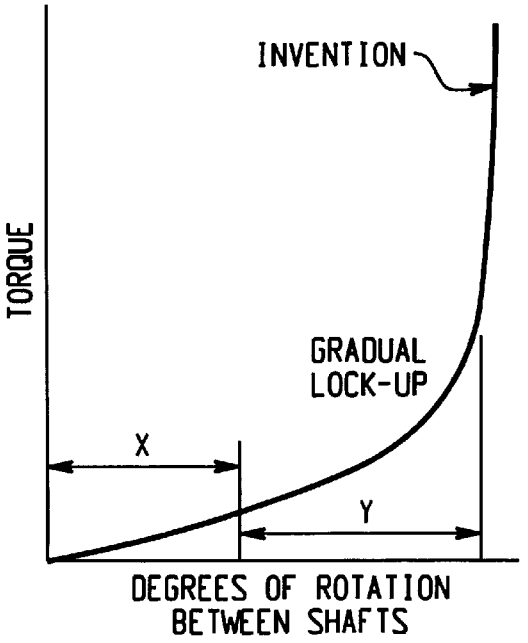

The result of this "variable geometry" configuration may be seen in the graph of FIG. 8 in which torque increase linearly with increasing rotation for awhile (section "X" of graph in FIG. 8), then torque begins to increase at an increasing rate, as a function of rotation for awhile (section "Y" in graph). Thereafter, with the spring wrapped about the surface 86 over the full length of the spring, torque increases on a substantially vertical line, as in FIG. 7. Thus, the present invention provides a blower having an improved torsion damping mechanism which has fewer parts, and is simpler and more compact. The variable geometry feature of the invention will reduce noise generated within the damping mechanism by reducing the sudden impact of engagement by the spring. Furthermore, the mechanism can readily be tuned or adapted to different engine applications, as will now be explained in greater detail.

On any given supercharger design, the inertia load of the timing gears and rotors is always the same, for a given unit size. Therefore, the spring (and the spring rate) can be the same for any application of that particular supercharger. When that particular supercharger is applied to a different engine having, for example, a higher impulse loading, the only required change in the design of the damping mechanism is to decrease the diameter of the outer cylindrical surface 86, thus increasing the available spring travel and the total input torque which can be absorbed by the damping mechanism. As is understood by those skilled in the art, if the impulse loading (torque) to drive the timing gears exceeds the product of the spring rate and the spring travel, the timing gears will be "unloaded" or negatively loaded, and undesirable backlash and gear rattle will occur.

As a corollary to what has been stated above regarding "tuning" the mechanism for different engine applications, changing the shape (slope) of the surfaces 86 and 88 will change the slope of section Y of the graph in FIG. 8, i.e., the rate of change of the transmitted torque, as a function of the relative rotation of the shafts 54 and 60. Of course, changing the slope of the surfaces 86 and 88 may also effectively change the travel limit, by varying the amount of relative rotation which can occur between the shafts 54 and 60.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rotary blower comprising a housing, first and second meshed lobed rotors rotatably disposed in the housing for transferring relatively low pressure inlet port air to relatively high pressure outlet port air; first and second meshed timing gears fixed to the first and second rotors, respectively, for preventing contact of the meshed lobes; an input drive adapted to be rotatably driven by a positive torque, about an axis of rotation in one drive direction at speeds proportional to speeds of a periodic combustion, torque transmitting engine selectively controllable between idle and relatively higher speeds; and a torsion damping mechanism for transmitting engine torque from said input drive) to said first timing gear; characterized by:

(a) said torsion damping mechanism comprising one of said input drive and said first timing gear defining an inner cylindrical surface, and one of said input drive and said first timing gear defining an outer cylindrical surface, both said inner and said outer surfaces being concentric about said axis of rotation;

(b) a helical torsion spring having an input end fixed to rotate with said input drive and an output end fixed to rotate with said first timing gear;

(c) said torsion spring defining a normal inside diameter, surrounding said outer cylindrical surface, and spaced apart therefrom by an amount corresponding to a predetermined positive travel limit; and (d) said torsion spring defining a normal outside diameter, being surrounded by said inner cylindrical surface, which is spaced apart therefrom by an amount corresponding to a predetermined negative travel limit.

2. A rotary blower as claimed in claim 1, characterized by both of said input drive and said first timing gear cooperating to define said inner cylindrical surface.

3. A rotary blower as claimed in claim 1, characterized by both of said input drive and said first timing gear cooperating to define said outer cylindrical surface.

4. A rotary blower as claimed in claim 1, characterized by said amount by which said normal inside diameter of said torsion spring is spaced apart from said outer cylindrical surface varies over the axial length of said torsion spring whereby the transition from operation in an isolation mode to operation in a direct drive mode, under positive torque, occurs gradually.

5. A rotary blower as claimed in claim 1, characterized by said amount by which said outer cylindrical surface is spaced apart from said normal outside diameter of said torsion spring varies over the axial length thereof, whereby the transition from operation in an isolation mode to operation in a drive mode, under negative torque, occurs gradually.

6. A rotary blower as claimed in claim 1, characterized by said input drive comprises an input shaft and an input hub, and said input hub defines a drive portion, and said first timing gear defines a driven portion, said drive and driven portions cooperating to define said inner and outer cylindrical surfaces.

7. A rotary blower as claimed in claim 6, characterized by said drive and driven portions each define a portion of each of said inner and outer cylindrical surfaces.

* * * * *